US005137074A

United States Patent [19]

Gonzalez

[11] Patent Number: 5,137,074

[45] Date of Patent: Aug. 11, 1992

[54] SPHERICAL BEARING OVERLAY CASTING PROCESS

[75] Inventor: Cesar Gonzalez, Wichita, Kans.

[73] Assignee: The Cessna Aircraft Company, Wichita, Kans.

[21] Appl. No.: 594,048

[22] Filed: Oct. 9, 1990

[51] Int. Cl.[5] ..... B22D 19/00; B22D 29/00

[52] U.S. Cl. ..... 164/98; 164/69.1; 164/131

[58] Field of Search ..... 164/98, 91, 94, 95, 164/69.1, 70.1, 76.1, 120, 137, 131

[56] References Cited

U.S. PATENT DOCUMENTS

| | | | |
|---|---|---|---|
| 1,738,438 | 12/1930 | Landers | 164/98 |
| 1,938,257 | 12/1933 | Jones | 164/120 |
| 2,833,638 | 5/1958 | Owen | 164/97 |
| 3,967,013 | 6/1976 | Danis | 29/527.4 |
| 4,779,665 | 10/1988 | Ouimet | 164/120 |
| 4,794,685 | 1/1989 | Hillier | 164/69.1 |
| 4,903,386 | 2/1990 | Teramachi | 164/97 |

FOREIGN PATENT DOCUMENTS

| | | | |
|---|---|---|---|
| 502321 | 7/1930 | Fed. Rep. of Germany | 164/120 |
| 61-23822 | 2/1986 | Japan | 164/100 |
| 2-41759 | 2/1990 | Japan | 164/133 |

*Primary Examiner*—Richard K. Seidel
*Assistant Examiner*—Rex E. Pelto
*Attorney, Agent, or Firm*—Edward L. Brown, Jr.

[57] ABSTRACT

The invention is a method of forming a spherical bearing shell comprising an overlay casting process which utilizes a ceramic insert having a semi-spherical close-tolerance outer surface with a casting sprue opening therethrough and lubrication ribs on said outer surface. The ceramic insert is placed within structural bearing housing, defining an overlay cavity therebetween which is then cast with a molten bearing alloy into the sprue opening of the insert to a level above the height of the overlay cavity. The sprue opening is then back-drilled so that the ceramic insert and plug of bearing alloy can be separated from the bearing housing and overlay surface leaving a semi-spherical bearing surface with lubrication grooves cast therein.

7 Claims, 1 Drawing Sheet

SPHERICAL BEARING OVERLAY CASTING PROCESS

BACKGROUND OF THE INVENTION

The invention relates to spherical bearings utilizing overlay cast bearing shells and the method of forming said bearing shells. Spherical bearings which have had very specialized use in commercial designs, provide a rotational connection joint between two elements. An example would be a piston rod which rotates in multiple planes with a reciprocating piston which moves linearly. A spherical bearing of the type involved in the present invention is taught in FIG. 5 of applicant's pending application Ser. No. 512,120, entitled Axial Cylinder Internal Combustion Engine. Overlay spherical bearings in the prior art have generally been formed by filling the bearing housing with cast bearing metal, and then machining away the bearing overlay material to form the finished spherical bearing surface therein. This of course involves substantial machining on the inside surface of the bearing shell including accurate shaped lubrication grooves in the finished spherical bearing surface.

The present invention substantially reduces these machining requirements since the spherical bearing surface and its attendant lubrication grooves are provided at the time of the casting of the bearing overlay material.

DESCRIPTION OF THE INVENTION

The complete bearing which utilizes the method of the present invention is illustrated in FIGS. 4 and 5 of applicant's pending application, mentioned above.

The piston rod is formed with a spherical ball at its end for receipt in a semi-spherical bearing shell with lubrication grooves in its surface. The other half of the bearing shell is split in the center into two half-ring inserts which are held in place by a retaining nut. Overlay bearings include a structural housing which gives the bearing strength and the bearing alloy which is cast to the housing in one or more layers and will be referred to as the overlay.

Before casting the overlay surface of the bearing, a thin-walled ceramic insert is formed and fired which has on its outer surface a semi-spherical surface closely conforming to the finished bearing contours, including a series of lubrication ribs or protuberances extending outwardly from said surface. The insert is placed in the bearing housing so as to define an overlay cavity between the bearing housing and ceramic insert. The molten overlay alloy is then gravity or pressure cast into the top of the insert with the molten metal passing through the sprue opening and filling the overlay cavity to a height above the overlay cavity so that the cavity is completely filled with molten bearing material. The solidified bearing alloy in the sprue opening may be back-drilled through the bottom or top of the bearing housing so that the insert and the plug of solidified bearing alloy therein can be separated from the bearing shell. After the insert is removed, the excess cylindrical section of the bearing housing is cut away and the molded bearing overlay surface is polished or possibly lightly machined to its finished dimensions and finish.

The principal object of the present invention is to provide a casting process for spherical overlay bearings with a minimum amount of machining.

Another object of the present invention is to provide an overlay casting process which mold forms the lubrication grooves in the bearing surface.

Other objects, features and advantages of the invention will become more apparent upon reference to the following detailed description, and to the drawings illustrating the preferred embodiments thereof, wherein.

DETAILED DESCRIPTION OF THE PREFERRED EMBODIMENT

Figure 1:
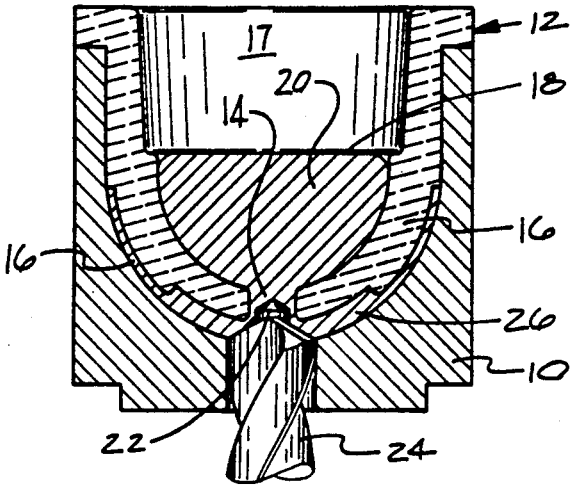
FIG. 1 is a sectional view through the bearing housing, casting insert and overlay casting material.
Figure 2:
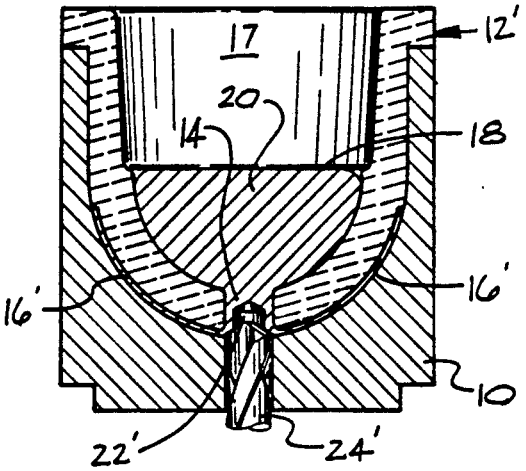
FIG. 2 is a similar section view of the casting process of a modified bearing shell with lubrication grooves which join the casting sprue.

Referring to FIG. 1, the open-ended bearing housing 10 is shown with a ceramic insert 12 positioned in the open end of the housing with a semi-spherical cavity 26 defined therebetween. When casting the overlay, the molten bearing alloy is gravity or pressure filled to a level 18 which is higher than the upper edges of cavity 26 so as to fully form and fill the cavity 26. The ceramic insert 12 includes a concentrically positioned sprue opening 14 which allows the molten alloy metal to flow to the outside surface of the insert 12, filling cavity 26.

Figure 3:
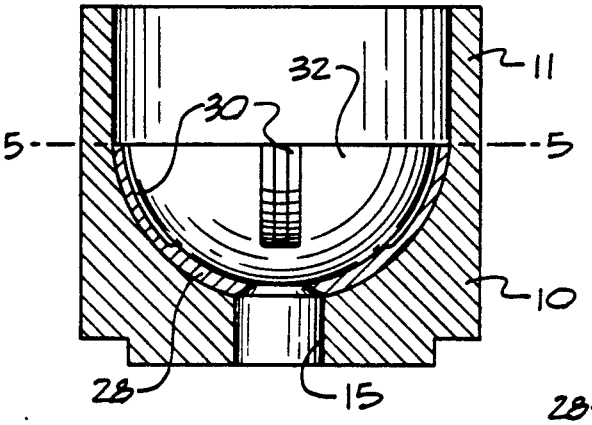
FIG. 3 is a similar sectional view to FIG. 1 with the ceramic insert and alloy plug removed from the bearing housing.
Figure 7:
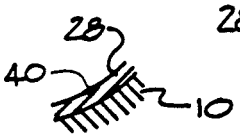
FIG. 7 is partial section of a bearing shell illustrating a lubrication pocket rather than a groove.
Figure 5:
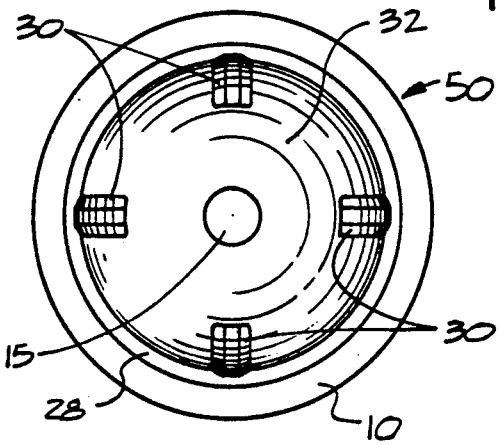
FIG. 5 is a top plan view of the finished bearing shell of FIG. 3.

Ceramic insert 12 includes one or more outwardly extending ribs 16 which extend only partially downward in the spherical bearing surface. These outwardly extending ribs 16 on the ceramic insert 12, when molded, form similar shaped grooves 30 in the bearing surface, as seen in FIGS. 3 and 5. The spacing of the grooves and number of grooves will vary with the design. In place of grooves, pockets or dimples 40 can be cast in the overlay as shown in FIG. 7. These pockets are utilized to retain lubricants therein.

To remove the bearing insert 12 and plug 20, the housing 10 is back-drilled forming a small diameter bore 22 up into sprue opening 14, as seen in FIG. 1. Bore 22 is then redrilled with a larger diameter bit 24 up to close proximity with the ceramic insert 12 to vary the diameter of the lubrication entry bore 15. This back-drilling operation could also be performed by a stepped drill bit having a small diameter end portion of equivalent diameter to bore 22.

Once the back-drilling is complete, the small annular area of alloy metal remaining in the sprue 14 can be easily sheared so that the ceramic insert 12 and plug 20 of excess bearing alloy can be removed from the bearing housing 10.

Figure 4:
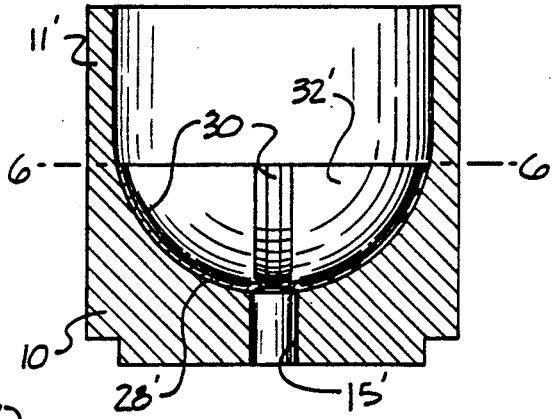
FIG. 4 is a similar sectional view to FIG. 2 with the insert and plug removed.
Figure 6:
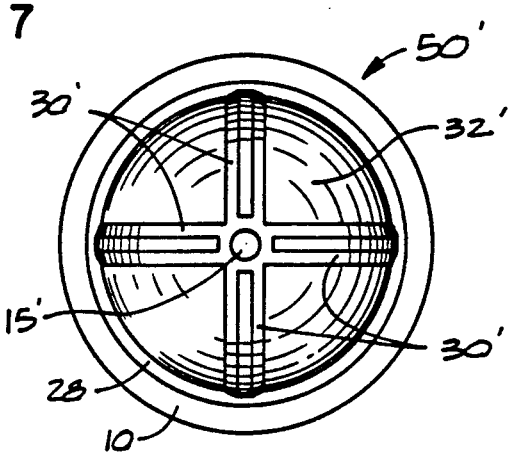
FIG. 6 is a top plan view of the finished bearing shell of FIG. 4.

Once the overlay 28 has been cast and the insert 12 removed, the upper excess cylindrical portion of the bearing housing 11 is cut away along line 5—5 of FIG. 3, and discarded leaving a bearing shell 50, as seen in FIG. 5. In FIGS. 4 and 6, the lubrication grooves 30' extend the full depth of the spherical surface 32' and join with bore 15', which supplies lubrication oil to grooves 30'. In FIG. 4, the excess cylindrical portion of the housing 11 is cut away and discarded along line 6—6, leaving a complete bearing shell 50', as seen in FIG. 6.

The overlay 28 can be cast by gravity through the insertion of a molten metal alloy to a fill level 18, as shown in the drawings, or it could also be pressure-cast from bore 15, if desired.

The ceramic shell 12 can be formed with a large open center area 17 (FIG. 1), or it can be formed solid with a continuing sprue opening all the way through the insert 12.

The overlay bearing metal is an alloy of varying elements depending upon the combined sliding velocity and bearing contact pressure requirements of the bearing. The thickness of the overlay will vary with the bearing requirements. The outer spherical surface of ceramic insert 12 is dimensionally very close to the finished spherical radiuses so that a minimum amount of machining will be required with the lubrication grooves 30 already in place. Bearings with less tolerance requirement can be cast to a finished dimension with no machinery required.

Having described the invention with sufficient clarity to enable those familiar with the art to construct and use it, I claim:

1. The method of forming a spherical bearing shell comprising an overlay casting process including the steps of:

forming an open-ended structural bearing housing of steel;

molding a ceramic insert having a semi-spherical close-tolerance outer surface with a casting sprue opening therethrough and lubrication protuberance on said outer surface;

placing the insert in the structural bearing housing thereby defining a bearing overlay cavity therebetween;

casting the overlay in the housing by introducing a molten-bearing alloy into the sprue opening of the ceramic insert to a level above the height of the overlay cavity;

back-drilling the sprue opening whereby the ceramic insert can be sheared from the overlay bearing surface leaving a semi-spherical bearing surface with lubrication pockets or grooves cast therein.

2. A method as set forth in claim 1 wherein the ceramic insert is thin-walled with a hollow center, the casting sprue opening being concentric with the bearing shell and the ribs in the outer surface of the shell are spaced therearound.

3. A method as set forth in claim 1 wherein the ceramic insert is thin-walled with a hollow center, the casting sprue opening being concentric with the bearing shell and the ribs being arcuately shaped radiating outward from the sprue opening.

4. A method as set forth in claim 1 wherein the back-drilling is accomplished through the bottom of the bearing housing.

5. A method as set forth in claim 1 wherein the back-drilling is accomplished through the bottom of the bearing housing with a stepped bit, the smaller diameter portion of the bit removing overlay in the sprue opening while the larger diameter portion forms the lubrication passage in the bearing housing.

6. A method as set forth in claim 1 wherein the back-drilling is accomplished down through the sprue opening for the center of the ceramic insert.

7. A method as set forth in claim 1 wherein the casting of the overlay is performed by pressure casting.

* * * * *